United States Patent [19]

Jones

[11] 4,065,051

[45] Dec. 27, 1977

[54] REFUSE CONTAINER

[76] Inventor: Frederick J. Jones, 2310 Cherry Ridge Lane, Brandon, Fla. 33511

[21] Appl. No.: 701,523

[22] Filed: July 1, 1976

[51] Int. Cl.[2] ..... B65D 91/00

[52] U.S. Cl. ..... 232/43.2; 232/43.5

[58] Field of Search ..... 232/27, 53, 43.1, 43.2, 232/43.3, 43.5

[56] References Cited

U.S. PATENT DOCUMENTS

| | | | |
|---|---|---|---|
| 1,214,389 | 1/1917 | Toth | 232/43.5 |
| 1,364,892 | 1/1921 | Schulte et al. | 232/43.5 |
| 1,921,933 | 8/1933 | Levenberg et al. | 232/43.1 |
| 2,228,008 | 1/1941 | Groff | 232/43.1 |
| 2,495,505 | 1/1950 | Bella | 232/43.5 |
| 3,799,430 | 3/1974 | Huguenin | 232/43.2 |

*Primary Examiner*—Roy D. Frazier
*Assistant Examiner*—Peter A. Aschenbrenner
*Attorney, Agent, or Firm*—Arthur W. Fisher, III

[57] ABSTRACT

A refuse container means comprising an upper and lower container member arranged in telescoping relation relative to each other configured for storage within a container receptacle. A plurality of cables disposed within corresponding plurality of guards extend between the upper and lower container members. The lower end of the cables are secured to a corresponding plurality of discharge doors hingedly attached to the lower portion of the lower container member while the upper end of the cables are secured to the upper container member. The telescoping relation relative between the upper and lower container members permits movement between an extended and retracted position to selectively open and close the discharge doors to dump refuse from the refuse container means when in the retracted position and close the discharge door when in the extended position.

12 Claims, 3 Drawing Figures

REFUSE CONTAINER

BACKGROUND OF THE INVENTION

1. Field of the Invention

A refuse container means comprising an upper and lower container member arranged in telescoping relation relative to each other configured for storage within a container receptacle.

2. Description of the Prior Art

Most commonly, refuse or trash receptacles used in private homes kept outside comprise containers with removeable lids. These receptacles are emptied by removing the lids and inverting the containers. Unfortunately the containers are easily overturned and the contents strewn about. Moreover, the contents may stick to the bottom or become lodged so that when inverting the contents are not discharged.

Further efforts include containers provided with door closure means at the bottom thereof and means for operating the closure door means. Such closure means may include a plurality of leaves hinged to the bottom edge of the container. The door closure means in turn may comprise a hydraulic or pneumatic control system to selectively open the leaves. The resulting open configuration is funnel-like and permits the material in the container to be dropped without scattering.

Another example of hinged doors as bottom closures comprises two similar sections which are hingedly connected to opposed parallel bottom edges of the side or end walls. These hinged bottom sections or doors are adapted to swing downwardly when the contents of the container are to be discharged, so as to release such contents. Such door operating devices provides means for opening and closing the bottom doors and may also comprise means whereby the container may be lifted by crane or the like. One such container includes chains which extend vertically on two opposite side walls of the container, each chain being connected by branch chains to both bottom doors and being provided at its upper end with means engageable by a crane hook. Thus when lifted the entire weight of the receptacle is transmitted to the crane hook by the door controlling devices to hold the doors tightly closed. The doors are releasable to discharge the contents of the container only after the crane hook has been disengaged from the device.

Unfortunately such devices are complicated in structure and therefore expensive. Thus, there is a need for a reliable, relatively inexpensive refuse container adapted to home use.

SUMMARY OF THE INVENTION

The present invention relates to a refuse container means. More specifically the refuse container means comprises an upper and lower container member arranged in telescoping relation relative to each other to selectively open and close access doors hingedly attached to the lower portion of the lower member. The upper and lower container members are specifically configured for storage within a container receptacle.

The upper container member comprises a first substantially hollow cylindrical element having a pair of guide slots formed on opposite sides of the lower periphery thereof. A lid or top element having a centrally disposed aperture formed therein is affixed to the upper portion of the first element. Hingedly attached, to the lid or top element is an access door to selectively permit access to the refuse container means for depositing trash and refuse therein. Extending upwardly from the lid or top element is a lift attachment for lifting and lowering refuse container means as more fully described hereinafter.

The lower container member comprises a second substantially hollow cylindrical member having appair of guide keys formed on opposite sides of the upper portion thereof. A plurality of discharge doors is hingedly attached to the lower portion of the lower container member to selectively permit discharge of refuse and trash from the refuse container means. A support rim is formed about the mid-portion of the second member to open the discharge doors as more fully described hereinafter.

Extending substantially the length of the upper and lower container elements is a plurality of cables corresponding to the plurality of discharge doors. The upper portion of each cable extends through the lid or top and is secured by fastener means. The opposite or lower portion of each cable is attached to its corresponding discharge door adjacent the inner wall of the second member.

The receptacle comprises an open cylindrical body having a support ledge formed about the upper portion thereof to operatively support the upper and lower container members as more fully described hereinafter.

In use the upper and lower members are stored within the receptacle, the lower surface of the lid or top on the support ledge. The depth of the receptacle is sufficiently greated than the depth of the upper and lower member to maintain the two in the extended position to maintain the discharge doors in the closed position. Refuse may therefore be deposited and stored through the access doors.

To discharge, the upper and lower members are lifted by any suitable hoist means affixed to the lifted attachment means. While in this position, the upper and lower members are held in the extended position by the weight of the lower member and the contents therein. When the upper and lower members are then placed in a refuse receiver such as a garbage truck the support rim engages the truck permitting the upper member to move downwardly to the retracted position. As the upper member moves downwardly, the discharge doors are opened permitting refuse to discharge. As the upper and lower members are lifted upward, the upper member is initially moved upwardly until the discharge doors are closed (extended position) at which time the lower member is then also lifted. The upper and lower members are then returned to the receptacle. Since the upper and lower members as well as the receptacle are cylindrical in shape, the upper and lower member are easily returned to the receptacle. To prevent rotation between the upper and lower members corresponding guide slots and guide keys cooperatively form an alignment means.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWING

For a fuller understanding of the nature and objects of the invention, reference should be had to the following detailed description taken in connection with the accompanying drawings in which.

Similar reference charaters refer to similar parts throughout the several views of the drawings.

DETAILED DESCRIPTION OF THE PREFERRED EMBODIMENT

Figure 1:
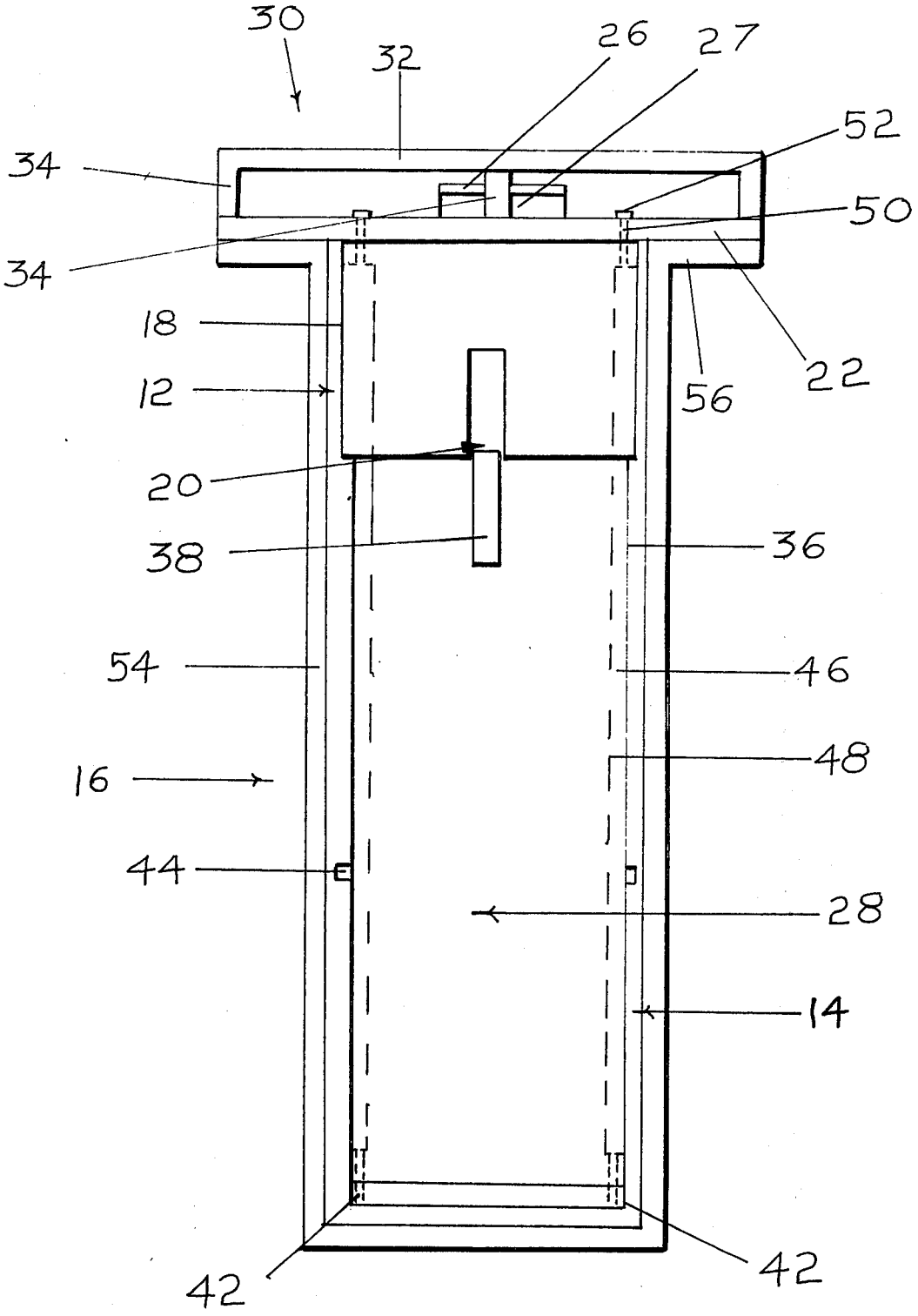
FIG. 1 is a side view of a refuse container means in the extended position.
Figure 2:
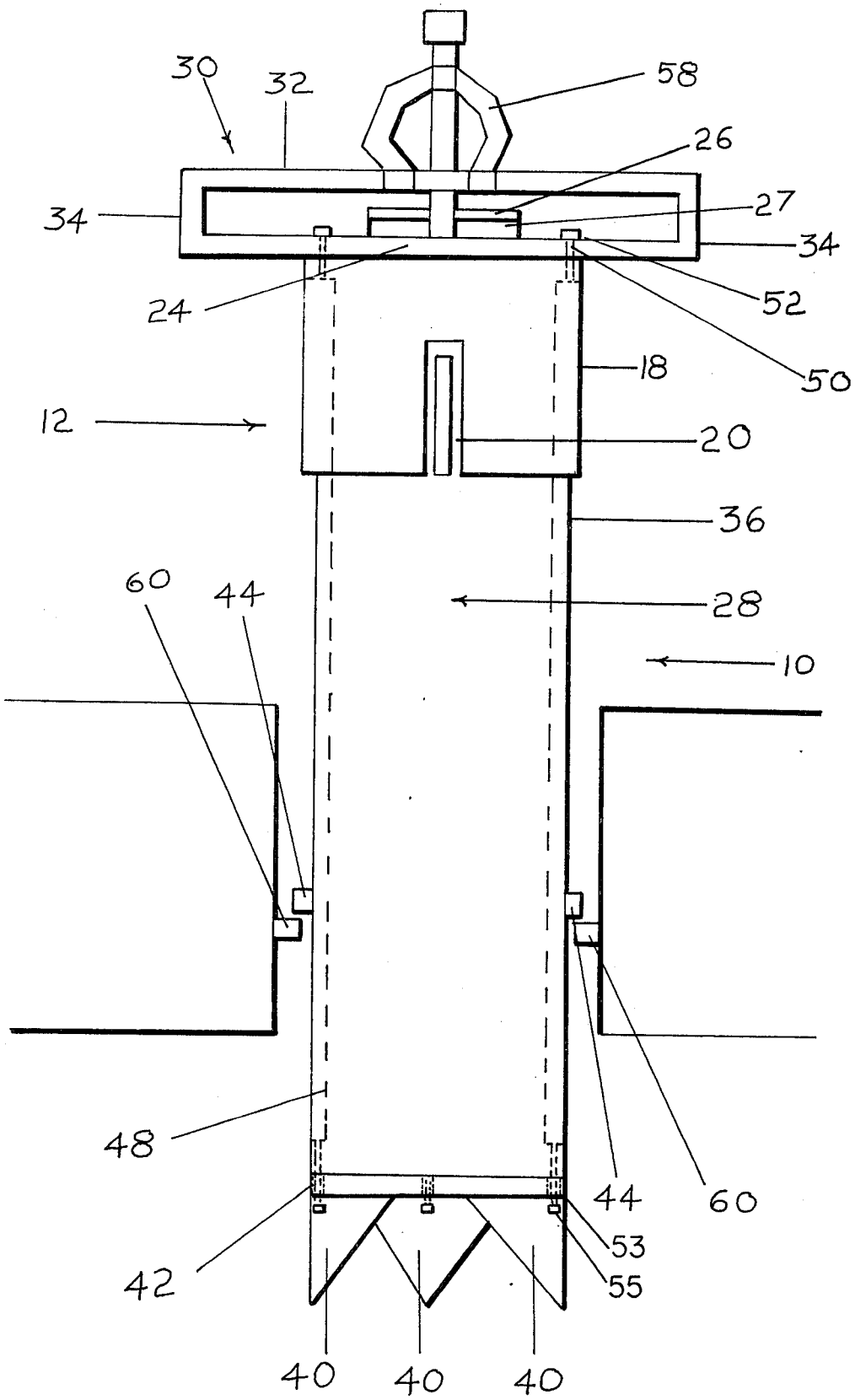
FIG. 2 is a side view of the refuse container in the retracked position.
Figure 3:
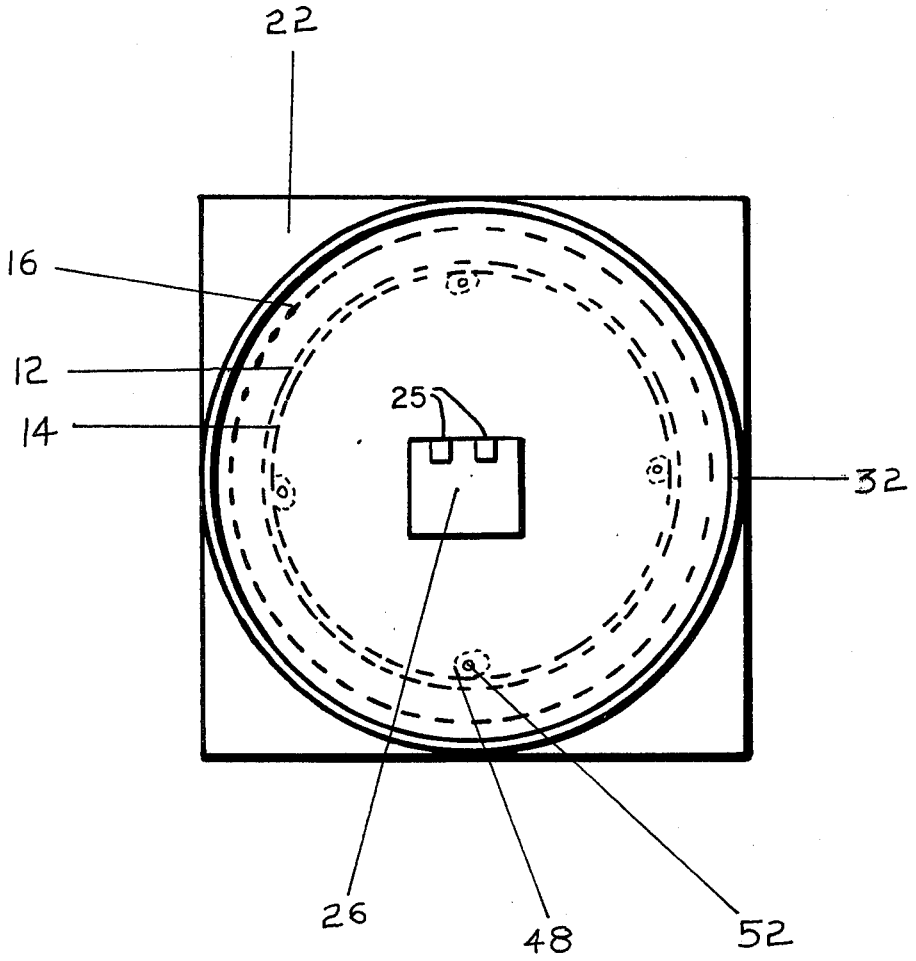
FIG. 3 is a top view of the refuse container means.

As shown in FIG. 1 and 2, the invention relates to a refuse container means generally indicated as 10. The refuse container means 10 comprises an upper and lower container members generally indicated as 12 and 14 respectively. As described more fully hereinafter, the upper and lower container members 12 and 14 are specifically configured for storage within a container recptacle general indicated are 16.

The upper container member 12 comprises a first substantially hollow cylindrical element 18 having a pair of guide slots 20 formed on opposite sides of the lower periphery thereof. A lid or top element 22 having a centrally disposed aperture 24 formed therein is affixed to the upper portior of first element 18. Hingedly attached to the lid or top element 22 on hinges 25 is an access door 26 supported on an access chute 27 to selectively permit access to the interior 28 of the refuse container means 10 for depositing trash and refuse therein. Extending upwardly from the lid or top element 22 is a lift attachment generally indicated as 30 for lifting and lowering the refuse container means 10 as more fully described hereinafter. The lift attachment means 30 comprises a substantially circular lift ring 32 held in fixed spaced relation above the lid or top element 22 by support legs 34.

The lower container member 14 comprises a second substantially hollow cylindrical member 36 having a pair of guide keys 38 formed on opposite sides of the upper portion thereof. A plurality of discharge doors 40 is hingedly attached to the lower container member 14 by hinges 42 to selectively permit discharge of refuse and trash from the refuse container means 10. A support rim 44 is formed about the mid-portion of the second member 36 to open the discharge doors 40 as more fully described hereinafter.

Extending substantially the length of the upper and lower container elements 12 and 14 is a plurality of cables 46 corresponding to the plurality of discharge doors 40. Each cable 46 is enclosed within a cable guard or shield 48 affixed to the inner surface of the second member 36 to prevent refuse from becoming entangled on the cable 46. The upper portion of each cable 46 extends through a corresponding aperture 50 formed in the lid or top 22 and secured by fastener means 52. The opposite or lower portion of each cable 46 is attached to its corresponding discharge door 40 adjacent the inner wall of second member 36. Specifically, each cable 46 extends through a corresponding aperture 53 formed in each discharge door 40 and secured by fastener means 55.

As shown in FIG. 1, the receptacle 16 comprises an open cylindrical body 54 having a support ledge 56 formed about the upper portion thereof to operatively support the upper and lower container members 12 and 14 as more fully described hereinafter.

In use the upper and lower members 12 and 14 are stored within the receptacle 16. The lower surface of the lid or top 22 is supported on the support ledge 56. The depth of the receptacle 16 is sufficiently greater than the depth of the upper and lower members 12 and 14 to maintain the two in the extended position to maintain the discharge doors 40 in the closed position. Refuse may therefore be deposited and stored in the interior 28 through the access doors 36.

To discharge the upper and lower members 12 and 14 are lifted by any suitable hoist means such as shown at 58 attached to lift attachment means 30. While in this position, the upper and lower members 12 and 14 are held in the extended position by the weight of the lower member 14 and the contents therein. When the upper and lower members 12 and 14 are then placed in a refuse receiver such as a garbage truck (shown/partial) the support rim 44 engages the truck at 60 permitting the upper member 12 to move downwardly to the retracked position. As the upper member 12 moves downwardly, the discharge doors 40 are opened permitting refuse to discharge from the interior 28. As the upper and lower member 12 and 14 are lifted upward, the upper member 12 is initially moved upwardly until the discharge doors 40 are closed (extended position) at which time the lower member 14 is then also lifted. This is accomplished as the upper and lower members 12 and 14 respectively are telescoped relative to each other changing the effective distance between the top element 22 and doors 40 causing the doors 40 to open and close under the force of the cables 46. The upper and lower member 12 and 14 are then returned to the receptacle 16. Since the upper and lower member 12 and 14 as well as the receptacle 16 are cylindrical in shape, the upper and lower members 12 and 14 are easily returned to the receptacle 16. To prevent rotation between the upper and lower members 12 and 14, corresponding guide slote 20 and guide keys 38 cooperatively forms an alignment means.

It will thus be seen that the objects set forth above, among those made apparent from the preceding description are efficiently attained and since certain changes may be made in the above construction without departing form the scope of the invention, it is intended that all matter containeddin the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. The refuse container means comprising an upper and lower container member arranged in telescoping relation relative to each other, said upper container member comprising a substantially hollow element having a lid attached to the upper portion thereof, said lid including an aperture formed therein and an access door hingedly attached thereto, said access door movable between an open and closed position to permit selective access to said refuse container when said access door is in said open position, said lower container member comprising a substantially hollow element having a plurality of discharge doors hingedly attached to the lower portion thereof, said hingedly attached discharge doors movable between an open and closed position to permit selective discharge from said refuse container means when said discharge doors are in said open position, and a plurality of cables corresponding to said plurality of discharge doors, each said cables attached to the first hollow element at the upper end and each said cable attached to said corresponding discharge door at the lower end thereof, said first and second substantially hollow element moveable between an extended and re retracted position such that said discharge doors are moved from said closed position to said open position when said first and second substantially hollow elements are in said retracted position and said discharge doors are moved from said discharge position to said closed position when said substantially hollow first and second element are moved from said retracted position to said extended position.

2. The refuse container means of claim 1 wherein said first and second substantially hollow elements are each substantially cylindrical, said second substantially hollow element being at least partially disposed within said first substantially hollow element.

3. The refuse container means of claim 2 further including an alignment means to prevent rotation of said first substantially hollow element relative to said second substantially hollow element.

4. The refuse container means of claim 3 wherein said alignment means comprises at least one guideslot formed on the periphery of said upper substantially hollow element and a corresponding guide key formed in the periphery of said lower substantially hollow element, said guide slot and said guide key disposed in engaging relation relative to each other.

5. The refuse container means of claim 4 wherein said alignment means comprises a pair of guide slots formed on opposite sides of said first substantially hollow element and a corresponding pair of guide keys formed on opposite sides of said second substantially hollow element, said corresponding guide slots and guide keys disposed to be in registery relative to each other.

6. The refuse container means of claim 1 further including a plurality of cable guards, each of said plurality of cable guards corresponding to one of each of said plurality of cables to substantially isolate said cables from the interior of said second substantially hollow element.

7. The refuse container means of claim 6 wherein said plurality of cable guards extends substantially the length of said upper and lower substantially hollow elements.

8. The refuse container means of claim 1 wherein said cables are attached to said discharge doors immediately adjacent the lower periphery of said second substantially element.

9. The refuse container means of claim 1 further including a receptacle means, said receptacle means comprising a substantially hollow body having a lip formed about the upper periphery thereof to operatively support said upper and lower substantially hollow elements by engaging the lower portion of said lid.

10. The refuse container means of claim 9 wherein said lid further includes a lift attachment means to permit lifting and returning of said upper and lower substantially hollow elements to and from said receptacle.

11. The refuse container means of 9 wherein the depth of said receptacle is sufficiently greater than said upper and lower substantially hollow elements to retain said upper and lower substantially hollow elements in said extended position when within said receptacle.

12. The refuse container means of claim 11 further including the support ramp formed about the outer periphery of said lower substantially hollow element to provide support thereto to permit said upper and lower substantially hollow elements to move from said extended position to said retracted position when supported by an external means.

* * * * *